US008907851B2

(12) United States Patent
Kuo et al.

(10) Patent No.: US 8,907,851 B2
(45) Date of Patent: Dec. 9, 2014

(54) HANDHELD DEVICE AND PLANAR ANTENNA THEREOF

(75) Inventors: Yen-Liang Kuo, Taoyuan (TW); Chun-Wei Tseng, Taoyuan (TW); Wan-Ming Chen, Taoyuan (TW)

(73) Assignee: HTC Corporation, Taoyuan (TW)

( * ) Notice: Subject to any disclaimer, the term of this patent is extended or adjusted under 35 U.S.C. 154(b) by 803 days.

(21) Appl. No.: 13/114,437

(22) Filed: May 24, 2011

(65) Prior Publication Data

US 2012/0154224 A1 Jun. 21, 2012

(30) Foreign Application Priority Data

Dec. 17, 2010 (TW) ..... 99144452 A

(51) Int. Cl.
*H01Q 1/26* (2006.01)
*H01Q 1/24* (2006.01)
*H01Q 9/04* (2006.01)

(52) U.S. Cl.
CPC ..... *H01Q 1/243* (2013.01); *H01Q 9/0421* (2013.01); *H01Q 9/0442* (2013.01)
USPC ..... 343/702; 343/701; 343/703; 343/704; 343/705

(58) Field of Classification Search
USPC ..... 343/701–705
See application file for complete search history.

(56) References Cited

U.S. PATENT DOCUMENTS 6,542,126 B2 * 4/2003 Bahr et al. ..... 343/702

FOREIGN PATENT DOCUMENTS

| | | |
|---|---|---|
| EP | 1052722 | 11/2000 |
| EP | 1168495 | 1/2002 |
| EP | 1 693 925 | 8/2006 |
| WO | 2010/095803 | 8/2010 |

OTHER PUBLICATIONS

Search Report from corresponding European Application No. 11192103.7 dated Jan. 31, 2012.
Extended Search Report from corresponding European Application No. 11192103.7 dated Jun. 6, 2012.

* cited by examiner

*Primary Examiner* — Matthew Mikels
(74) *Attorney, Agent, or Firm* — Grossman, Tucker, Perreault & Pfleger, PLLC

(57) ABSTRACT

A handheld device and a planar antenna thereof are provided. The planar antenna comprises a radiator having a feeding point, a first short point and a second short point. The feeding point is coupled to a circuit board of the handheld device so that the handheld device transmits and receives a RF (radio frequency) signal through the radiator. The first short point is coupled to a ground of the circuit board so as to be grounded. A control element is disposed on the handheld device or the planar antenna in order to control the second short point to be selectively electrically coupled to the ground so that the planar antenna can operate at two different central frequencies. Furthermore, the planar antenna can operate at multiple central frequencies by changing a position of the second short point contacted to the radiator.

8 Claims, 6 Drawing Sheets

HANDHELD DEVICE AND PLANAR ANTENNA THEREOF

This application claims priority to Taiwan Patent Application No. 099144452 filed on Dec. 17, 2010, which is hereby incorporated by reference in its entirety.

CROSS-REFERENCES TO RELATED APPLICATIONS

Not applicable.

BACKGROUND OF THE INVENTION

1. Field of the Invention

The subject application relates to a handheld device and a planar antenna thereof. More particularly, the handheld device of the subject application can operate at multiple central frequencies by controlling short points of the planar antenna thereof.

2. Descriptions of the Related Art

With rapid development of wireless communications, demands on wireless communications also become increasingly higher. Among various wireless communication products, portable handheld devices are the most demanded by people nowadays. In order to satisfy the demands of modern people on thinner and lighter handheld devices, various antennas for the handheld devices have also been developed rapidly. Currently, built-in antennas that are hidden in the handheld devices have become the mainstream in the market, and among such built-in antennas, planar antennas are the most favored. This is mainly because that a planar antenna occupies a significantly reduced space in a handheld device. Accordingly, many researches and inventions related to planar antennas have occurred at an amazing speed.

As handheld devices having the function of supporting operation in a plurality of frequency bands are preferred by the users, antennas operable at multiple central frequencies have arisen. For a conventional planar antenna, in order to operate at multiple central frequencies, at least two radiators shall be provided as resonators for the central frequencies. Therefore, the structure of the conventional planar antenna is bound to be changed. In other words, in order for a handheld device to operate at more central frequencies, the antenna of the handheld device must be increased in size. Consequently, the handheld device is made to have an increased volume, which is in contradiction to the trend of miniaturization of handheld devices.

On the other hand, once a central frequency at which the conventional planar antenna is to operate is determined, the structure of the planar antenna is fixed. Therefore, it is difficult to change the central operating frequency without changing the antenna structure. For example, when a planar antenna operating at a central frequency of 900 MHz is to operate at a central frequency of 1800 MHz instead, the structure of the planar antenna has to be re-designed in order to achieve this purpose. However, it seems difficult for a user to change the central frequency at which the antenna can operate by changing the antenna structure. Therefore, for antenna designers, how to allow the handheld devices to support operation at a plurality of frequencies in a more convenient way will become an important issue in the future.

In view of this, an urgent need exists in the art to provide a solution that can change a central operating frequency of a planar antenna and provide a better communication quality without increasing the overall volume of the antenna.

SUMMARY OF THE INVENTION

An objective of the subject application is to provide a handheld device and a planar antenna thereof. By disposing a control element on the handheld device or the planar antenna, the planar antenna can be controlled to operate at a plurality of different central frequencies without increasing the overall volume of the planar antenna and changing the basic structure of the planar antenna. Furthermore, unlike the conventional planar antenna, the planar antenna of the subject application has only one radiator. Thus, the radiator structure of the planar antenna of the subject application has a reduced volume so that the planar antenna can be more effectively disposed within a clearance area of the handheld device and the clearance area can be utilized completely, thereby improving the communication quality of the handheld device. Specifically, in the case that the size of the clearance area is not reduced along with the overall volume of the planar antenna, influence of electronic components outside the clearance area on the planar antenna can be reduced to result in improved communication quality of the handheld device. On the other hand, in the case that the size of the clearance area is reduced along with the overall volume of the planar antenna, arrangement of the internal space of the handheld device can be made more flexible and the influence of the electronic components on the planar antenna can be minimized so as to maintain the communication quality of the handheld device.

To achieve the aforesaid objective, the subject application discloses a planar antenna for use in a handheld device. The handheld device comprises a circuit board. The planar antenna comprises a radiator, a feeding connector, a control element, a first short connector, and a second short connector. The radiator comprises a feeding point, a first short point and a second short point. The first short point is located at an end point of the radiator, the second short point is located at another end point of the radiator, and the feeding point is located between the first short point and the second short point. The feeding connector is configured to couple the feeding point to the circuit board so that the handheld device transmits and receives an RF (radio frequency) signal through the radiator. The first short connector is configured to electrically couple the first short point to a ground of the circuit board so that the first short point is grounded. The control element comprises a first switch coupled to the second short point. The second short connector is configured to couple the ground of the circuit board to the first switch so that the second short point is grounded when the first switch is turned on. The planar antenna operates at a first central frequency when the first switch is turned off and operates at a second central frequency when the first switch is turned on, and the second central frequency is different from the first central frequency.

Additionally, the subject application further discloses a handheld device. The handheld device comprises a body and a planar antenna. The body has a clearance area and a circuit board. The planar antenna is disposed in the clearance area of the body and is configured to transmit and receive an RF signal. The planar antenna comprises a radiator, a feeding connector, a first short connector, a control element and a second short connector. The radiator comprises a feeding point, a first short point and a second short point. The first short point is located at an end point of the radiator, the second short point is located at another end point of the radiator, and the feeding point is located between the first short point and the second short point. The feeding connector is configured to couple the feeding point to the circuit board so that the handheld device transmits and receives an RF signal through the radiator. The first short connector is configured to couple the first short point to a ground of the circuit board so that the first short point is grounded. The control element comprises a first switch coupled to the second short point. The second short connector is configured to couple the ground of the circuit board to the first switch so that the second short point is grounded when the first switch is turned on. The planar antenna operates at a first central frequency when the first switch is turned off and operates at a second central frequency when the first switch is turned on, and the second central frequency is different from the first central frequency.

Furthermore, the subject application further discloses a handheld device. The handheld device comprises a body, a control element and a planar antenna. The body has a clearance area and a circuit board. The control element comprises a first switch coupled to a ground of the circuit board. The planar antenna is disposed in the clearance area of the body and is configured to transmit and receive an RF signal. The planar antenna comprises a radiator, a feeding connector, a first short connector and a second short connector. The radiator comprises a feeding point, a first short point and a second short point. The first short point is located at an end point of the radiator, the second short point is located at another end point of the radiator, and the feeding point is located between the first short point and the second short point. The feeding connector is configured to couple the feeding point to the circuit board so that the handheld device transmits and receives the RF signal through the radiator. The first short connector is configured to couple the first short point to a ground of the circuit board so that the first short point is grounded. The second short connector is configured to couple the second short point to the first switch so that the second short point is grounded when the first switch is turned on. The planar antenna operates at a first central frequency when the first switch is turned off and operates at a second central frequency when the first switch is turned on, and the second central frequency is different from the first central frequency.

The detailed technology and preferred embodiments implemented for the subject application are described in the following paragraphs accompanying the appended drawings for people skilled in this field to well appreciate the features of the claimed invention.

DESCRIPTION OF THE PREFERRED EMBODIMENT

The subject application primarily relates to a handheld device and a planar antenna thereof. The handheld device can, through a control element disposed on the handheld device or the planar antenna, control the planar antenna to operate at a plurality of different central frequencies (i.e., to support operation at a plurality of frequency bands) without increasing the overall volume of the planar antenna and without changing the basic structure of the planar antenna. Description of the following embodiments is only for purpose of illustration rather than to limit the present invention. It shall be appreciated that, in the following embodiments and the attached drawings, elements unrelated to the present invention are omitted from depiction. Furthermore, dimensional relationships among individual elements in the attached drawings are illustrated only for ease of understanding but not to limit the actual scale.

Figure 1:
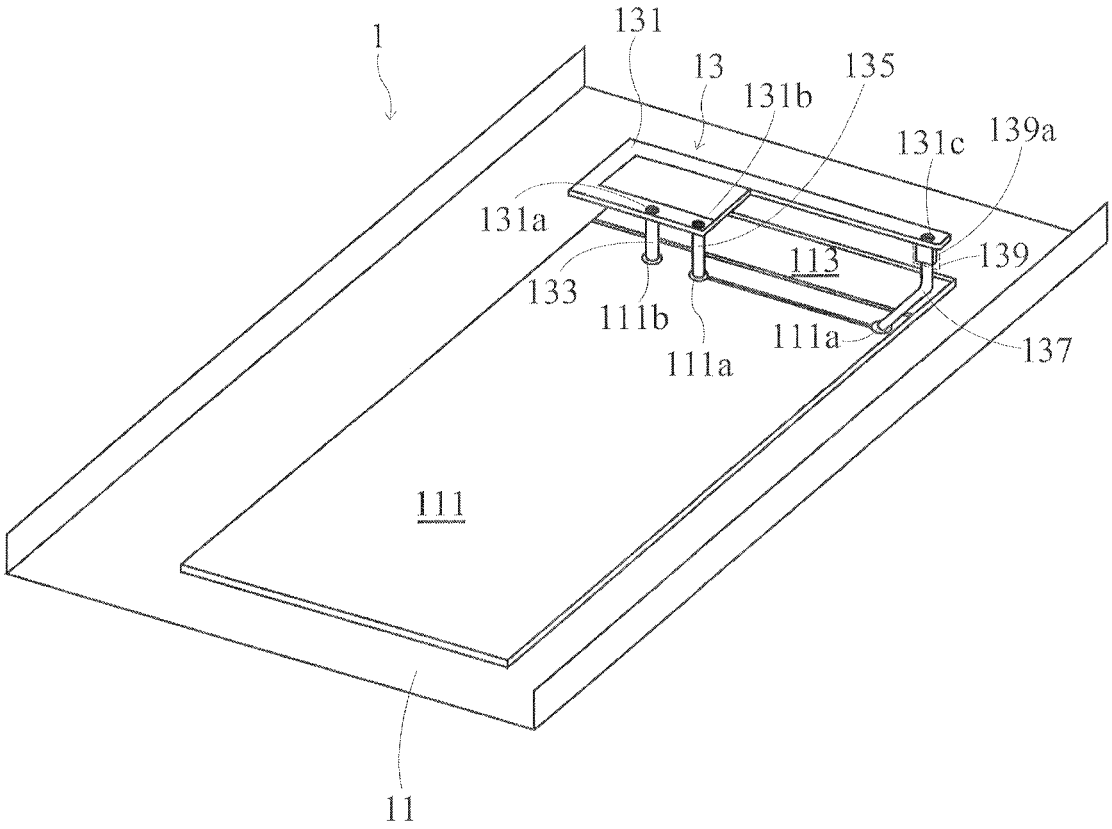
FIG. 1 is a schematic view of a handheld device 1 according to a first embodiment of the present invention.

FIG. 1 is a schematic view of a handheld device 1 according to a first embodiment of the present invention. The handheld device 1 at least comprises a body 11 and a planar antenna 13, and for simplicity of description, other elements such as a touch display module, a communication module, an input module, a power supply module and other essential elements are not depicted in the drawing. The body 11 at least comprises a circuit board 111 and a clearance area 113.

The planar antenna 13 is disposed within the clearance area 113. The planar antenna 13 comprises a radiator 131, a feeding connector 133, a first short connector 135, a second short connector 137 and a control element 139. The radiator 131 comprises a feeding point 131*a*, a first short point 131*b* and a second short point 131*c*. As shown in FIG. 1, the first short point 131*b* is located at an end point of the radiator 131, the second short point 131*c* is located at another end point of the radiator 131, and the feeding point 131*a* is located between the first short point 131*b* and the second short point 131*c*.

The first short connector 135 is configured to electrically couple the first short point 131*b* to a ground 111*a* of the circuit board 111 so that the first short point 131*b* is grounded. The feeding connector 133 is configured to couple the feeding point 131*a* to a signal terminal 111*b* of the circuit board 111 so that the handheld device transmits and receives an RF signal through the circuit board 111, the communication module and the radiator 131. Furthermore, the control element 139 comprises a first switch 139*a* that is coupled to the second short point 131*c*. The second short connector 137 is configured to couple the first switch 139*a* to the ground 111*a* of the circuit board 111.

In this embodiment, when the control element 139 turns off the first switch 139*a*, the second short point 131*c* functions as an open circuit. At this point, the planar antenna 13 would be considered as a planar antenna with ¼ wavelength resonating, and operates at a first central frequency which is determined by the length of the radiator. On the other hand, when the control element 139 turns on the first switch 139*a*, the second short point 131*c* is electrically coupled to the ground 111*a* of the circuit board 111 to function as a short circuit; as a result, a null point of a current path in the radiator 131 is changed and, accordingly, a resonant path of the radiator 131 is changed. At this point, the planar antenna 13 would be considered as a planar antenna with ½ wavelength resonating, and operates at a second central frequency that is different from the first central frequency. Here, the first central frequency can represent the operation mode in a low-band, and the second central frequency can represent the operation mode in a high-band.

It shall be appreciated that, positions of the individual elements in the handheld device 1 and the planar antenna 13 thereof of this embodiment are only illustrated to disclose the subject application, and modifications can be readily made thereon by those of ordinary skill in the art according to the disclosures of the subject application. Accordingly, positions of the circuit board 111 and the ground 111*a* thereof, positions of the feeding point 131*a*, the first short point 131*b* and the second short point 131*c* on the radiator 131, as well as positions of the feeding connector 133, the first short connector 135, the second short connector 137 and the control element 139 are not intended to limit the scope of the subject application. Furthermore, the first switch 139*a* disclosed in this embodiment may be an electronic switch, a manual switch or any other switching element having the switching function, so the type of the first switch 139*a* is not intended to limit the scope of the subject application either.

As can be known from the above description, in the first embodiment of the present invention, by turning on or off the first switch 139*a*, the resonant path of the radiator 131 is changed so that the planar antenna 13 can operate at two different central frequencies without changing the basic structure of the antenna; moreover, because only one radiator 131 is used in the planar antenna 13 and the radiator 131 is continuous, the planar antenna 13 have a reduced volume compared to a conventional dual-band planar antenna. Thus, with a reduced size, the planar antenna 13 can be more effectively disposed within the clearance area 113 of the handheld device 1 and the clearance area 113 can be utilized completely. In this way, the subject application eliminates the need of, in order to achieve a desired central operating frequency, having two radiators share the clearance area as in the conventional planar antenna. Therefore, in the case that the size of the clearance area remains the same, because there is only one radiator 131 existing in the clearance area 113 of the subject application, the communication quality of the handheld device can be improved; in other words, in the case that the size of the clearance area 113 is not reduced along with the overall volume of the planar antenna 13, the influence of electronic components outside the clearance area 113 on the planar antenna 13 can be reduced, so the communication quality of the handheld device can be improved. On the other hand, in the case that the size of the clearance area 113 is reduced along with the overall volume of the planar antenna 13, arrangement of the internal space of the handheld device 1 can be made more flexible and the influence of the electronic components on the planar antenna can be minimized so as to main the communication quality of the handheld device.

Figure 2:
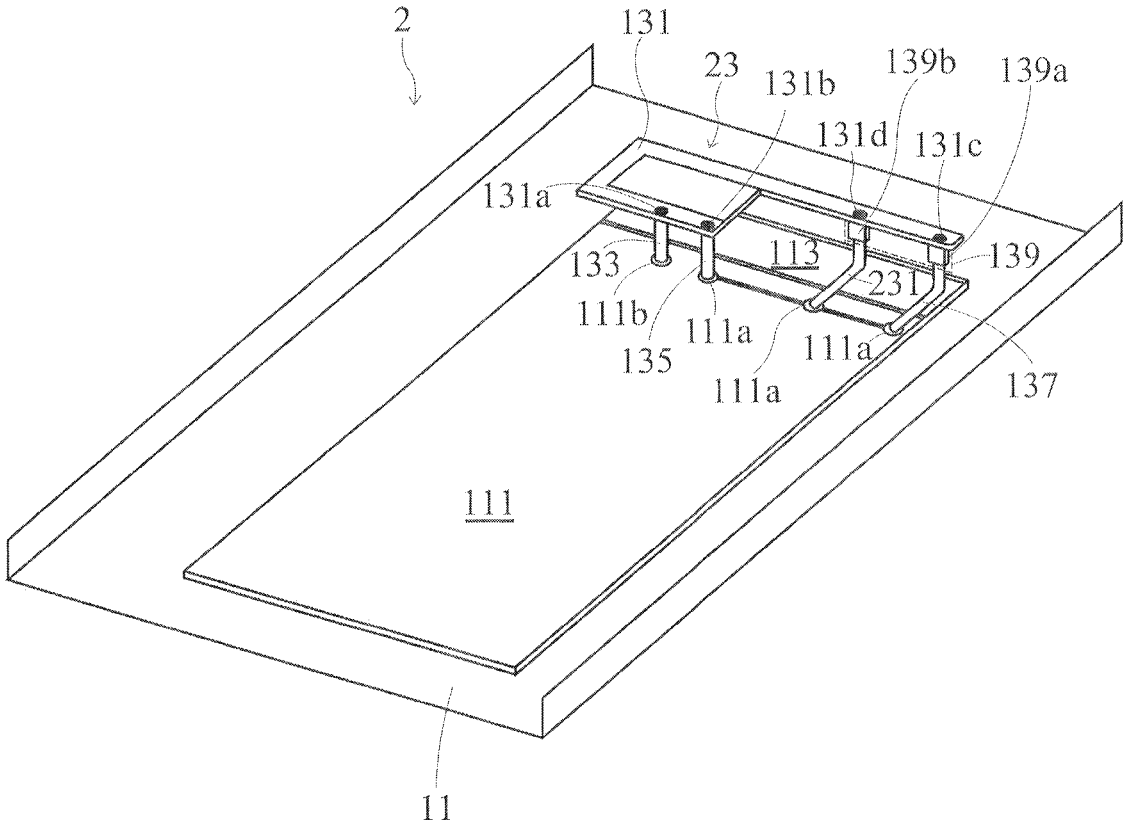
FIG. 2 is a schematic view of a handheld device 2 according to a second embodiment of the present invention.

FIG. 2 is a schematic view of a handheld device 2 according to a second embodiment of the present invention. Specifically, the second embodiment differs from the first embodiment mainly in that: apart from comprising a radiator 131, a feeding connector 133, a first short connector 135, a second short connector 137 and a control element 139, the planar antenna 23 further comprises a third short connector 231; apart from comprising a feeding point 131*a*, a first short point 131*b* and a second short point 131*c*, the radiator 131 further comprises a third short point 131*d*; and apart from comprising a first switch 139*a*, the first control element 139 further comprises a second switch 139*b* electrically coupled to the third short point 131*d*.

In the second embodiment, the third short connector 231 is electrically coupled between the second switch 139*b* and the ground 111*a* of the circuit board 111 so that the third short point 131*d* can be grounded through the switch 139*b*. When the control element 139 turns off the first switch 139*a* and the second switch 139*b*, as described in the first embodiment, the planar antenna 23 would be considered as a planar antenna with ¼ wavelength resonating, and operate at a first central frequency which is determined by the length of the radiator; here, and the first central frequency can represent the operation mode in a low-band. When the first switch 139*a* is turned on and the second switch 139*b* is turned off, also as described in the first embodiment, the planar antenna 23 operates at a second central frequency; here, the second central frequency can represent the operation mode in a first high-band. However, when both the first switch 139*a* and the second switch 139*b* are turned on, the third short point 131*d* is grounded; as a result, the null point of the current path in the radiator 131 is changed again so that the resonant path of the radiator 131 is changed accordingly. Thereby, the planar antenna 23 operates at a third central frequency, which can represent the operation mode in a second high-band. Thus, according to the second embodiment of the present invention, by turning on or off the first switch 139*a* and the second switch 139*b* under control of the control element 139, the resonant path of the radiator 131 is changed so that the planar antenna 23 can further operate at the third central frequency different from the first central frequency and the second central frequency without changing the basic structure of the antenna. In other words, the handheld device 2 not only has the same advantages as the handheld device 1, but also allows the planar antenna 23 thereof to operate at three different central frequencies; i.e., the handheld device 1 can support operation at multiple frequency bands.

Figure 3:
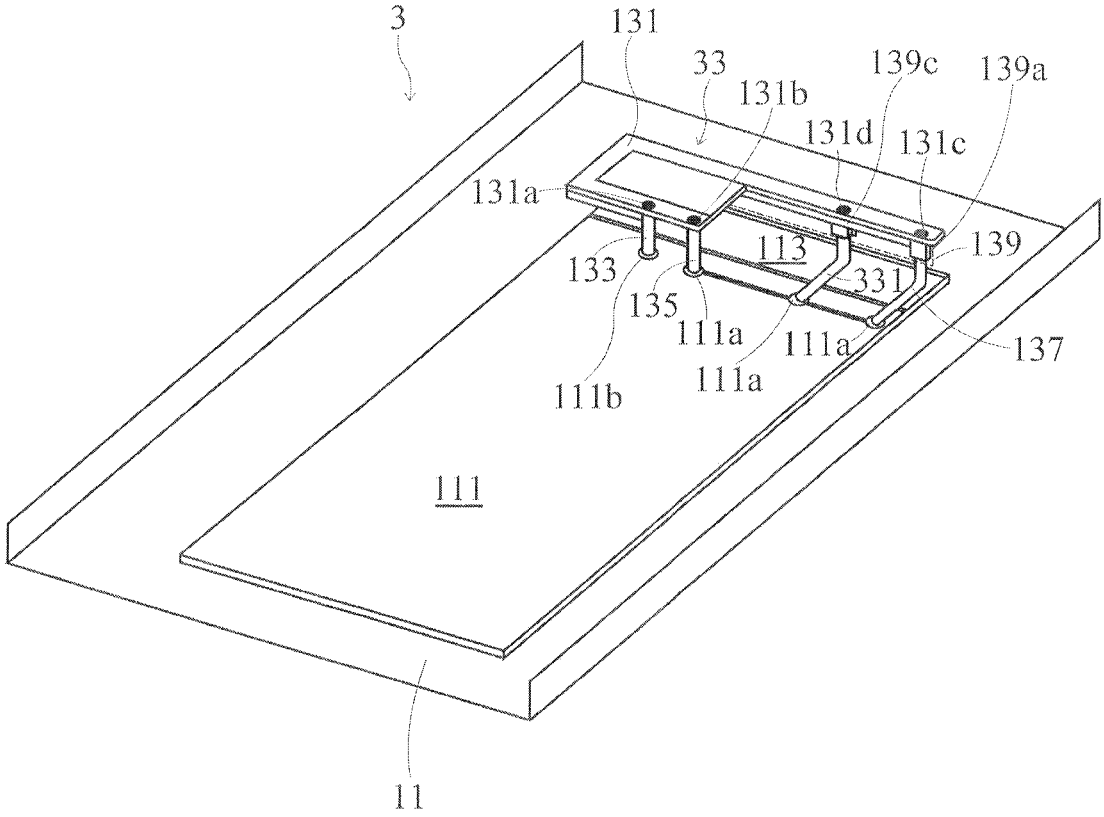
FIG. 3 is a schematic view of a handheld device 3 according to a third embodiment of the present invention.

Referring further to FIG. 3, there are depicted a handheld device 3 and a planar antenna 33 thereof according to a third embodiment of the present invention. Specifically, the third embodiment differs from the first embodiment mainly in that: the planar antenna 33 further comprises a third short connector 331, and the control element 139 further comprises a sliding switch 139*c*. The sliding switch 139*c* is dynamically coupled to the radiator 131 by sliding between the feeding point 131*a* and the second short point 131*c* of the radiator 131 so as to form a third short point 131*d*. A first terminal contact of the third short connector is coupled to the sliding switch 139*c* and a second terminal contact of the third short connector is dynamically electrically coupled to the ground 111*a* of the circuit board 111 as the sliding switch 139*c* is slid so that, when the sliding switch 139*c* is turned on, the third short point 131*d* is grounded.

Similarly, in this embodiment, when the first switch 139*a* and the sliding switch 139*c* are turned off, the planar antenna 33 would be considered as a planar antenna with ¼ wavelength resonating, and operates at a first central frequency which is determined by the length of the radiator; here, the first central frequency can represent the operation mode in a low-band. When the first switch 139*a* is turned on and the sliding switch 139*c* is turned off, the planar antenna 33 operates at a second central frequency, which can represent the operation mode in a first high-band. In the case that the first switch 139 is turned on, when the sliding switch 139*c* is turned on, the third short point 131*d* is electrically coupled to the ground 111*a* of the circuit board 111 through the sliding switch 139*c* and the third short connector 331 to function as a short circuit so that the third short point 131*d* generated according to the position of the sliding switch 139*c* will change the null point of the current path in the radiator 131. In other words, the resonant path in the radiator 131 will vary with the sliding position of the sliding switch so that the planar antenna 33 operates at an adjustable third central frequency; here, the third central frequency can represent the operation mode in a second high-band, and the adjustable third central frequency is different from the first central frequency and the second central frequency. More specifically, this embodiment can, according to different designs and operation modes, switch between high-bands having different central frequencies within a high-frequency band range; furthermore, this embodiment can also enlarge the operation bandwidth of the high-frequency band and support operation at multiple frequency bands.

It shall be appreciated that, the sliding switch 139*c* can be implemented by various floating mechanisms or micro-electromechanical technologies, and the sliding switch 139*c* of the subject application can be readily replaced with any switch having a moving function by those of ordinary skill in the art according to the disclosures the subject application. Accordingly, the type of the sliding switch 139*c* is not intended to limit the scope of the subject application.

Figure 4:
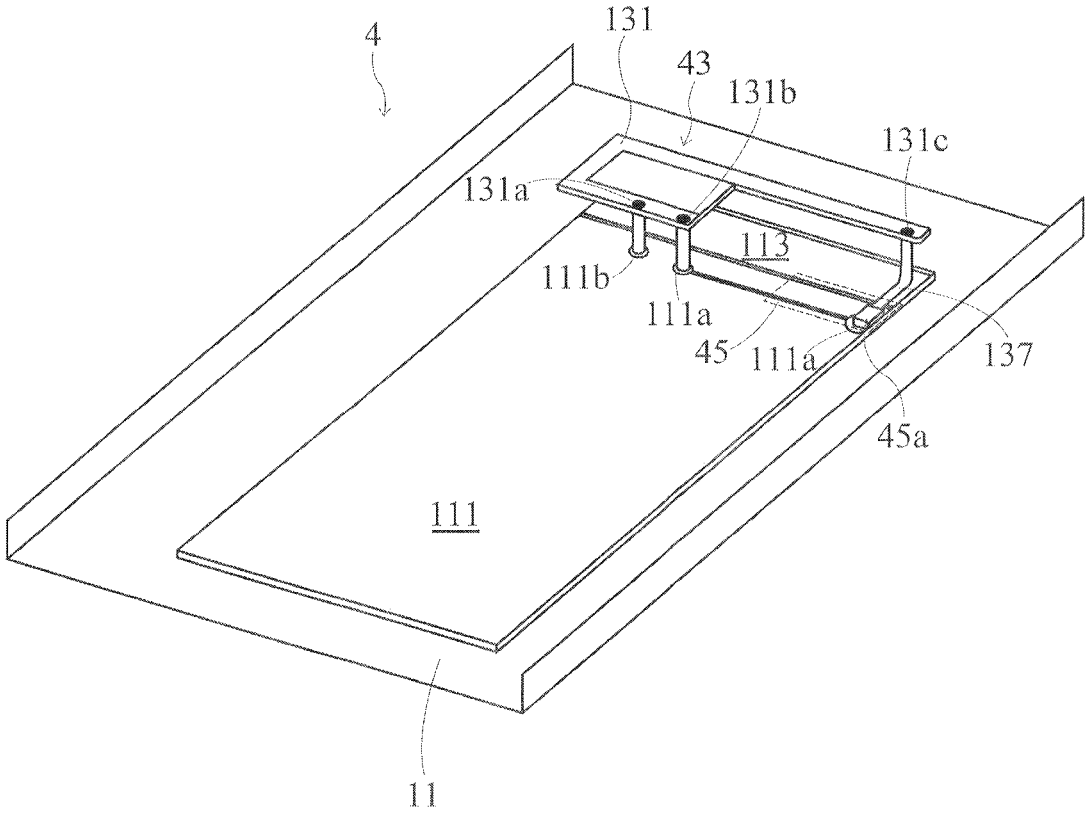
FIG. 4 is a schematic view of a handheld device 4 according to a fourth embodiment of the present invention.

A fourth embodiment of the present invention is shown in FIG. 4, which depicts a handheld device 4 and a planar antenna 43 thereof. Different from the first embodiment, the handheld device 4 further comprises a control element 45 disposed on the circuit board 111. The control element 45 comprises a first switch 45*a* that is electrically coupled to the ground 111*a* of the circuit board 111. Furthermore, the second short connector 137 of the planar antenna 43 is coupled between the second short point 131*c* of the radiator 131 and the first switch 45*a*. When the first switch 45*a* is turned on, the second short point 131*c* of the radiator 131 is grounded through the second short connector 137 and the first switch 45*a*.

As can be known from comparison between FIG. 1 to FIG. 3 and FIG. 4, in the first embodiment, the second embodiment and the third embodiment, the control element 139 is disposed on the planar antennas 13, 23, 33 and controls the respective switches in such a way that the short points are grounded through the switches and the short connectors respectively, thereby changing the operation frequency of the planar antennas; however, in the fourth embodiment, the control element 45 is disposed in the handheld device 4 (i.e., the planar antenna 43 does not contain the control element 45) and controls the first switch 45*a* in such a way that the second short point 131*c* is shorted to the ground through the second short connector 137 and the first switch 45*a*, thereby changing the operation frequency of the planar antenna.

Figure 5:
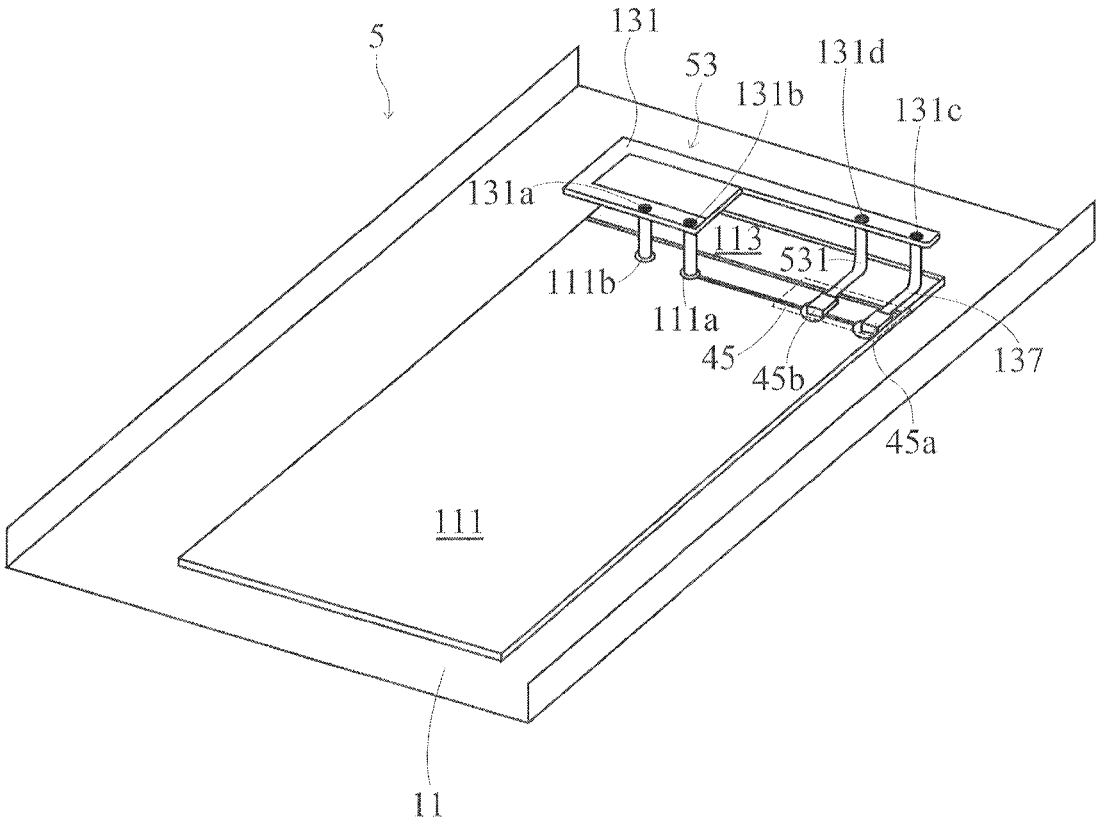
FIG. 5 is a schematic view of a handheld device 5 according to a fifth embodiment of the present invention.

A fifth embodiment of the present invention is shown in FIG. 5, which depicts a handheld device 5 and a planar antenna 53 thereof. In the handheld device 5, in addition to the same elements as those of the handheld device 4, the control element 45 of the handheld device 5 further comprises a second switch 45*b*, the planar antenna 53 further comprises a third short connector 531, and the radiator 131 of the planar antenna 53 further comprises a third short point 131*d*. The third short connector 531 is coupled between the third short point 131*d* of the radiator 131 and the second switch 45*b* so that when the second switch 45*b* is turned on, the third short point 131*d* of the radiator 131 is grounded. Accordingly, by means of the control element 45, the planar antenna 53 of the handheld device 5 can operate at three different frequencies.

Figure 6:
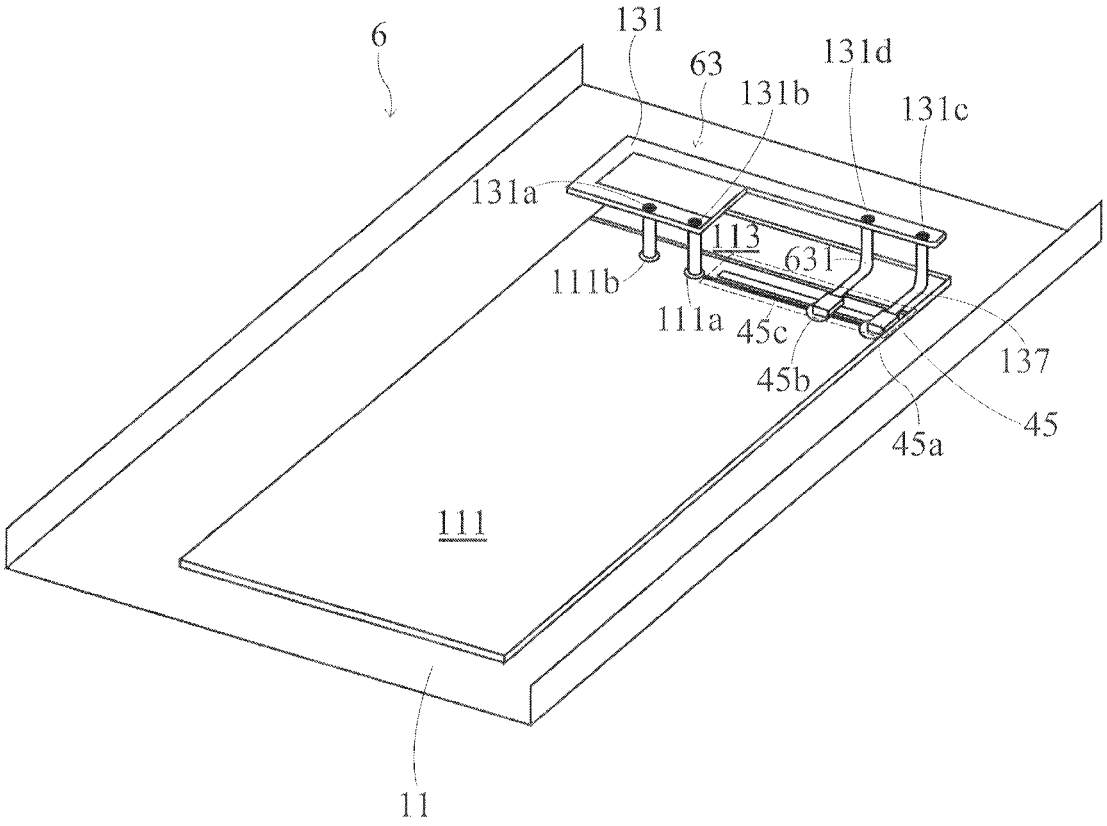
FIG. 6 is a schematic view of a handheld device 6 according to a sixth embodiment of the present invention.

A sixth embodiment of the present invention is shown in FIG. 6, which depicts a handheld device 6 and a planar antenna 63 thereof. In the handheld device 6, in addition to the same elements as those of the handheld device 4, the control element 45 of the handheld device 6 further comprises a sliding switch 45*c*, and the planar antenna 53 further comprises a third short connector 631. The third short connector 631 has a first terminal contact and a second terminal contact, and the first terminal contact is coupled to the sliding switch 45*c*. The sliding switch 45*c* is dynamically coupled to the ground 111*a* of the circuit board 111 by sliding between the feeding point 131*a* and the second short point 131*c* of the radiator 131. The second terminal contact is dynamically coupled to the radiator 131 as the sliding switch is slid so as to form a third short point 131*d*; thus, when the sliding switch 45*c* is turned on, the third short point 131*d* is grounded.

When the first switch 45*a* and the sliding switch 45*c* are turned on, the planar antenna 63 operates at a third central frequency different from the first central frequency and the second central frequency. Accordingly, by means of the control element 45, the planar antenna 63 of the handheld device 6 can operate at three different frequencies, in which the third central frequency can be further changed according to the sliding position of the sliding switch. As described in the aforesaid embodiments, this embodiment can, according to different designs and operation modes, switch between high-bands having different central frequencies within a high-frequency band range; furthermore, this embodiment can also enlarge the operation bandwidth in the high-frequency band and support operation at multiple frequency bands.

According to the above descriptions, by means of the control element and the short connectors, the handheld device and the planar antenna thereof of the subject application can change the null point of the current path in the radiator of the planar antenna to change the resonant path of the radiator. Therefore, the subject application can operate at two or more different central frequencies without changing the basic structure of the antenna; and by dynamically changing the null point of the current path in the radiator, the subject application can enlarge the range of central frequencies at which the antenna operates. Accordingly, compared to the conventional dual-band planar antenna, the planar antenna of the subject application utilizes only a single radiator and thus has a reduced antenna structure, which conforms to the demand for light and low-profile handheld devices. On the one hand, owing to the reduced antenna structure, the clearance area within the handheld device can be more effectively used to accommodate the planar antenna, thus mitigating the influence of other electronic components of the handheld device on characteristics of the planar antenna. On the other hand, in the case that the size of the clearance area is reduced along with the size of the planar antenna, arrangement of the internal space of the handheld device can be made more flexible.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A Planar antenna for use in a handheld device, the handheld device comprising a circuit board, the planar antenna comprising:

a radiator comprising a feed point, a first short point and a second short point, the first short point being located in an end point of the radiator, the second shoring point being located in another end point of the radiator, and the feeding point being located between the first short point and the second short point;

a feeding connector, being configured to couple the feeding point to the circuit board so that the handheld device transmits and receives a RF (radio frequency) signal through the radiator;

a first short connector, being configured to couple the first short point to a ground of the circuit board so that the first short point is grounded;

a control element comprising a first switch being coupled to the second short point;

a second short connector, being configured to couple the first switch to the ground of the circuit board so that the second short point is grounded when the first switch turns on; and a third short connector;

wherein the planar antenna operates at a first central frequency when the first switch turns off and operates at a second central frequency when the first switch turns on, and the second central frequency is different from the first central frequency; and wherein the radiator further comprises a third short point, the control element further comprises a second switch being coupled to the third short point, and the third short connector is configured to couple the second switch to the ground of the circuit board, wherein when the second switch turns on, the third short point is grounded so that the planar antenna operates at a third central frequency when both the first switch and the second switch turn on, and the third central frequency is different from the first central frequency and the second central frequency.

2. A Planar antenna for use in a handheld device, the handheld device comprising a circuit board, the planar antenna comprising:

a radiator comprising a feed point, a first short point and a second short point, the first short point being located in an end point of the radiator, the second shoring point being located in another end point of the radiator, and the feeding point being located between the first short point and the second short point;

a feeding connector, being configured to couple the feeding point to the circuit board so that the handheld device transmits and receives a RF (radio frequency) signal through the radiator;

a first short connector, being configured to couple the first short point to a ground of the circuit board so that the first short point is grounded;

a control element comprising a first switch being coupled to the second short point;

a second short connector, being configured to couple the first switch to the ground of the circuit board so that the second short point is grounded when the first switch turns on; and a third short connector having a first terminal contact and a second terminal contact;

wherein the planar antenna operates at a first central frequency when the first switch turns off and operates at a second central frequency when the first switch turns on, and the second central frequency is different from the first central frequency; and wherein the control element further comprises a sliding switch being dynamically coupled to the radiator by sliding between the feeding point and the second short point of the radiator so as to form a third short point, the first terminal contact of the third short connector is coupled to the sliding switch, and the second terminal contact of the third short connector is dynamically coupled to the ground of the circuit board as sliding the sliding switch, wherein when the sliding switch turns on, the third short point is grounded so that the planar antenna operates at a third central frequency when both the first switch and the sliding switch turn on, and the third central frequency is different from the first central frequency and the second central frequency.

3. A handheld device, comprising:

a body having a clearance area and a circuit board;

a planar antenna disposed in the clearance area of the body, being configured to transmit and receive a RF signal, the planar antenna comprising:

a radiator comprising a feed point, a first short point and a second short point, the first short point being located in an end point of the radiator, the second short point being located in another end point of the radiator, and the feeding point being located between the first short point and the second short point;

a feeding connector, being configured to couple the feeding point to the circuit board so that the handheld device transmits and receives the RF signal through the radiator;

a first short connector, being configured to couple the first short point to a ground of the circuit board so that the first short point is grounded;

a control element comprising a first switch being configured to couple to the second short point; and a second short connector, being configured to couple the first switch to the ground of the circuit board so that the second short point is grounded when the first switch turns on;

wherein the planar antenna operates at a first central frequency when the first switch turns off and operates at a second central frequency when the first switch turns on, and the second central frequency is different from the first central frequency.

4. The handheld device as claimed in claim 3, wherein the planar antenna further comprises a third short connector, the radiator further comprises a third short point, the control element further comprises a second switch being coupled to the third short point, and the third short connector is configured to couple the second switch to the ground of the circuit board, wherein when the second switch turns on, the third short point is grounded so that the planar antenna operates at a third central frequency when both the first switch and the second switch turn on, and the third central frequency is different from the first central frequency and the second central frequency.

5. The handheld device as claimed in claim 3, wherein the planar antenna further comprises a third short connector having a first terminal contact and a second terminal contact, the control element further comprises a sliding switch being dynamically coupled to the radiator by sliding between the feeding point and the second short point of the radiator so as to form a third short point, the first terminal contact of the third short connector is coupled to the sliding switch, and the second terminal contact of the third short connector is dynamically coupled to the ground of the circuit board as sliding the sliding switch, wherein when the sliding switch turns on, the third short point is grounded so that the planar antenna operates at a third central frequency when both the first switch and the sliding switch turn on, and the third central frequency is different from the first central frequency and the second central frequency.

6. A handheld device, comprising:

a body having a clearance area and a circuit board;

a control element comprising a first switch being coupled to a ground of the circuit board;

a planar antenna disposed in the clearance area of the body, being configured to transmit and receive a RF signal, the planar antenna comprising:

a radiator comprising a feed point, a first short point and a second short point, the first short point being located in an end point of the radiator, the second short point being located in another end point of the radiator, and the feeding point being located between the first short point and the second short point;

a feeding connector, being configured to couple the feeding point to the circuit board so that the handheld device transmits and receives the RF signal through the radiator;

a first short connector, being configured to couple the first short point to a ground of the circuit board so that the first short point is grounded; and a second short connector, being configured to couple the second short point to the first switch so that the second short point is grounded when the first switch keeps on;

wherein the planar antenna operates at a first central frequency when the first switch turns off and operates at a second central frequency when the first switch turns on, and the second central frequency is different from the first central frequency.

7. The handheld device as claimed in claim 6, wherein the planar antenna further comprises a third short connector, the radiator further comprises a third short point, the control element further comprises a second switch being coupled to the third short point, and the third short connector is configured to couple the second switch to the ground of the circuit board, wherein when the second switch turns on, the third short point is grounded so that the planar antenna operates at a third central frequency when both the first switch and the second switch turn on, and the third central frequency is different from the first central frequency and the second central frequency.

8. The handheld device as claimed in claim 6, wherein the planar antenna further comprises a third short connector having a first terminal contact and a second terminal contact, the control element further comprises a sliding switch, the first terminal contact of the third short connector is coupled to the sliding switch, the sliding switch is dynamically coupled to the ground of the circuit board by sliding between the feeding point and the second short point of the radiator, and the second terminal contact of the third short connector is dynamically electrically coupled to the radiator as sliding the sliding switch so as to form a third short point, wherein when the sliding switch turns on, the third short point is grounded so that the planar antenna operates at a third central frequency when both the first switch and the sliding switch turn on, and the third central frequency is different from the first central frequency and the second central frequency.

* * * * *